US005288073A

United States Patent [19]

Noël

[11] Patent Number: 5,288,073

[45] Date of Patent: Feb. 22, 1994

[54] GOLF SWING TRAINING DEVICE

[76] Inventor: Philippe Noël, 4530 Clark, Suite 103, Montréal, Québec, Canada

[21] Appl. No.: 16,020

[22] Filed: Feb. 10, 1993

[30] Foreign Application Priority Data

Jul. 23, 1992 [CA] Canada ..... 2074550

[51] Int. Cl.[5] ..... A63B 69/36

[52] U.S. Cl. ..... 273/186.1; 273/191 R

[58] Field of Search ..... 273/186.1, 186.2, 186.3, 273/187.4, 191 R, 192; 434/252

[56] References Cited

U.S. PATENT DOCUMENTS 3,604,712 9/1971 Albro ..... 273/191 R X
4,261,573 4/1981 Richards ..... 273/191 R
4,486,020 12/1984 Kane et al. ..... 273/191 R
4,580,786 4/1986 Shipley ..... 273/191 R
4,653,757 3/1987 Wilkinson ..... 273/191 R

*Primary Examiner*—George J. Marlo
*Attorney, Agent, or Firm*—Helfgott & Karas

[57] ABSTRACT

The disclosure herein describes a device to assist in the teaching of a golfer's swing and includes a rigid rod having one end mounted to a vertical surface attachment and an opposite end on which slides, through an appropriate connecting member, the shaft of a golf club or simulated club. The connection between rod and shaft allows a pivotal movement therebetween while that part of the connecting member in which is mounted the rod, allows it to freely slide longitudinally thus allowing an instructor or the golfer himself or herself to have an indication, as a result of the location of the connecting member on the rod, whether the golf swing is proper or improper for a given golfer.

11 Claims, 4 Drawing Sheets

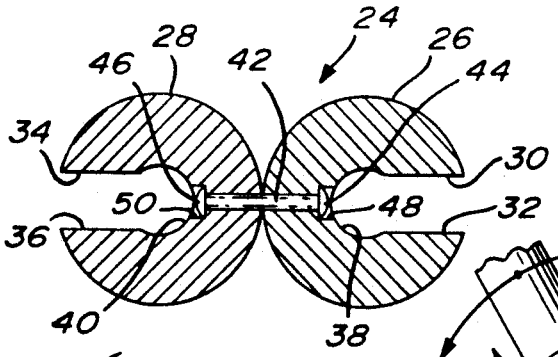
Fig. 3
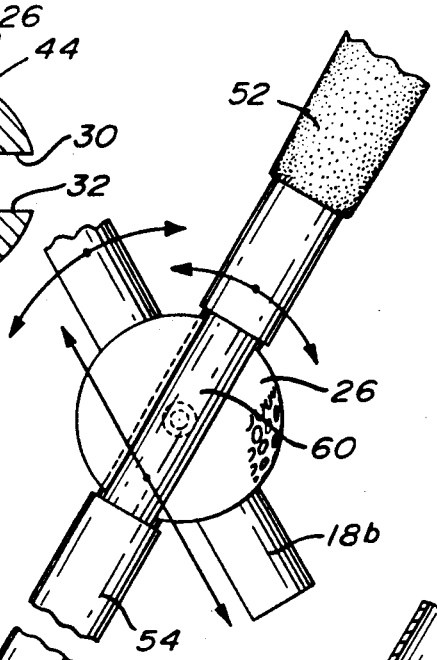
Fig. 4
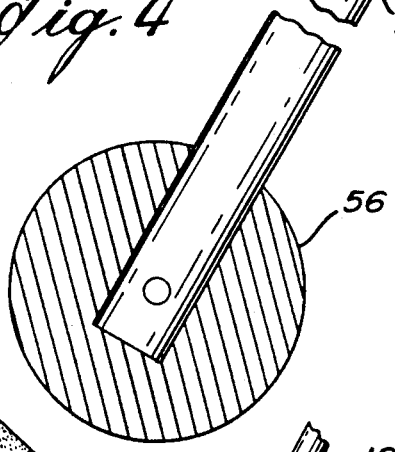
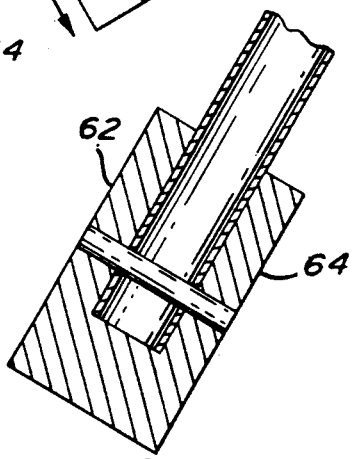
Fig. 5
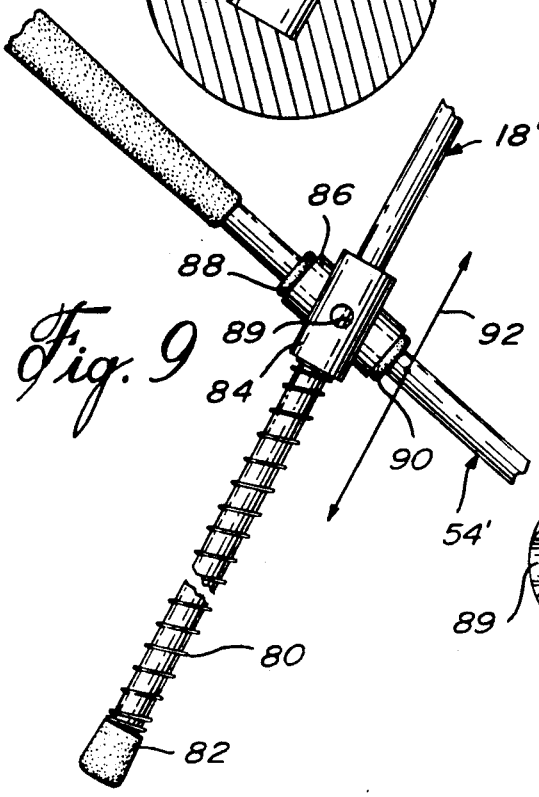
Fig. 9
Fig. 10
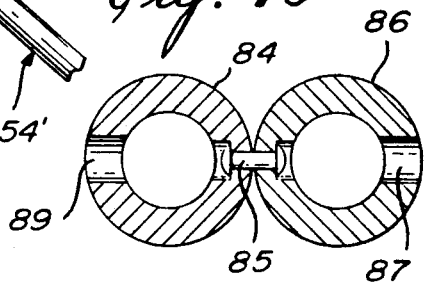

GOLF SWING TRAINING DEVICE

FIELD OF THE INVENTION

The present invention pertains to a device which will assist in the teaching of a golfer's swing; more particularly, the invention relates to a device which will indicate to an instructor or to the golfer himself or herself whether his or her swing is correct or incorrect.

BACKGROUND OF THE INVENTION

Many devices have been developed to assist a golfer to improve his or her swing. Swing theories tend to describe and materialize the golf swing as a wheel, the axis being the golfer's neck and the rim being at the ball. The club, or simulated club, slides backward on the rim or on a plane parallel to the radius of the wheel, up to the top of the swing. At this point, there is a re-route of the club head, described as a "loop"; then, the downward swing follows the same path, parallel to the rim or to the radius of the wheel. According to golf instructors, such loop is necessary to promote a squared club face at impact on the target line. During the follow-through and finish, the club continues the same process.

Another important feature is the action of the hands. In a correct right-handed golf swing, the left hand "climbs" over the right hand on the backswing (pronation) to finish at the top in a position known as the tray position. On the downswing, it reverses, the right hand "climbing" over the left hand (supination). Depending on golf instructors, beliefs, this should be done with or without alteration of the angle at the back of the wrist, formed by the left forearm and the hand.

In order to achieve one of the above features or both, many devices have been developed with or without attachments.

Canadian patent No. 518,637 of Plunkett issued Nov. 15, 1955 describes a device without an attachment, the club bearing on guides to control the orientation and position of the club face when swung.

Various devices have been developed with an attachment wherein a line or a rope is anchored to an immoveable object at one end and is attached and secured at the other end to part of a golf club: see, for example, Canadian patent No. 872,391 of Gentry issued Jun. 1, 1971.

A more recent patent, Canadian patent No. 1,185,633 issued Apr. 16, 1985 to Kane et al , describes a golfer practice swing device which uses an elongated rigid rod and a clamp which engages the shaft of a golf club by gripping a portion thereof to secure against unpurposeful disengagement. Connection means are associated with the clamp to mechanically connect the clamp to the rod for pivotal movement of the clamp and the shaft with respect to the rod about an axis parallel to that of the shaft. The length of the rod is such that, when the device is in use, the shaft will be guided towards a proper swing plane and will be turned a require amount for pronation and supination. Consequently, the head of the club will be guided towards a proper swing path. Hence, with this device, the golfer is forced to swing in a predetermined golf swing path.

There are two important elements in a golf swing: the plane and the arc. Referring to the above described "wheel" swing, the rim is the arc (which is the path of travel of the club head) and the radius is the plane. It has been established, through computer analysis, that, in a reasonable proper swing, the arc should not be shortened during the backswing but, on the downswing, it must slightly shorten and move to the left (for a right-handed golfer). The plane and its angle is dictated by two elements: the golfer's club (known as the shaft plane) and the golfer's own physical aptitudes. Hence, a golfer has his or her "own swing plane" and there are as many swing planes as there are golfers.

Hence, the concept of a swing being a wheel needs to be carefully revised.

Because of the loop created at the top of the swing, due to a change of direction and weight transfer, the golfer creates a second path or a "second wheel" which is above the one created during the backswing. These "wheels" meet at the bottom but separate at the top. In other words, the downswing is slightly above the backswing. This promotes and encourages a position, known as the delay, which consists in keeping the club head away from the ball as long as possible. After impact, as the golfer turns his or her body to the left and begins to raise, he or she also turns and moves the axis of the wheel and the rim (right to left, down to up); it also slides slightly to the left. This means that the epicenter of the swing moves constantly during the swing.

Referring to the devices described above and others which tend to materialize these concept, none describes and achieves all the movements in a very simple and efficient device. If the action of the hands is an important aspect of the teaching, then the plane and the arc remain constant factors of a swing. If the concept is that of a hoop, it should be able to move constantly right to left, up and down in order to follow the positions of the wheel and the displacements of the epicenter.

In a device using an anchor to an immoveable object or surface at one end thereof and an attachment to a club at the other end thereof, the variations of the radius created between the anchor and the club must be considered. From full length at address position and, preferably at waist level, this radius decreases from waist to top. Then, on the downswing, it returns to its full length while approaching the impact zone. This full length is kept until more or less at waist level on the follow-through and decreases again up to the finish position.

OBJECTS AND STATEMENT OF THE INVENTION

It is an object of the present invention to provide a simple, inexpensive swing golf device which enables to demonstrate and teach to the user the proper positions for one's own swing abilities in terms of arc and plane.

It is a further object of the present invention to provide a swing golf device which will allow the golfer to train from the longest to the shortest club with the appropriate positions (such as set up, address, arc, plane) in relation with any alignment (square, open, close) in any situation (full swing, half swing, chipping, bunkers).

It is also an object of the present invention to provide a device which will allow the methods pertaining to teaching the cross-over hand action with the proper delay and daggering effect on the downswing. It will also adapt to any kind of finish position.

The present invention therefore relates to a device to assist in the teaching of a golfer's swing which comprises:

attachment means adapted to be mounted to a vertical surface;

an elongated rigid rod having one end mounted in a swivel manner to the attachment means and an opposite end;

a shaft of a golf club or simulated club mounted to the rod adjacent the opposite end thereof; and connecting mounting the shaft to the rod, the connecting means including:

first means receiving therein the rod in a sliding manner whereby the connecting means may be displaced longitudinally along rod; and second means receiving therein the shaft in a restrictive manner so that the connecting means is prevented from longitudinal movement along the shaft;

The first and the second means being pivotally connected to one another so as to permit relative pivotal movement of the rod and the shaft to one another.

Thus, the present invention will allow an instructor to examine during a full swing the position of the shaft relative to the rod to indicate whether the golfer's swing is proper or not.

The present device is also a self-training device in that some indication means may be provided on the rod to indicate to the golfer whether his or her swing is correct or not. This can be achieved by having an instructor indicate to a particular golfer that the distance of the shaft to the end of the rod should be at a determined distance. Hence, in preferred forms of the invention, visual or audible means may be provided on the rod so that the golfer may see or hear during his or her swing whether the shaft is properly located with respect to the rod.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

For better understanding of the present invention, reference is had to the following description taken in connection with the accompanying drawings in which:

FIG. 3 is a cross-sectional view of the connection means;

FIG. 4 is an enlarged elevational view of a junction of the shaft and rod;

FIG. 5 is a cross-sectional view of a simulated club head;

FIGS. 1 and 2, shows the free end of the rod with visual indication means thereon;

FIG. 9, which is shown on the sheet illustrating FIGS. 3–5, is an enlarged view of another embodiment of a junction and end of an invention made in accordance with the present invention.

DESCRIPTION OF PREFERRED EMBODIMENTS

Figures 1, 2, 6:
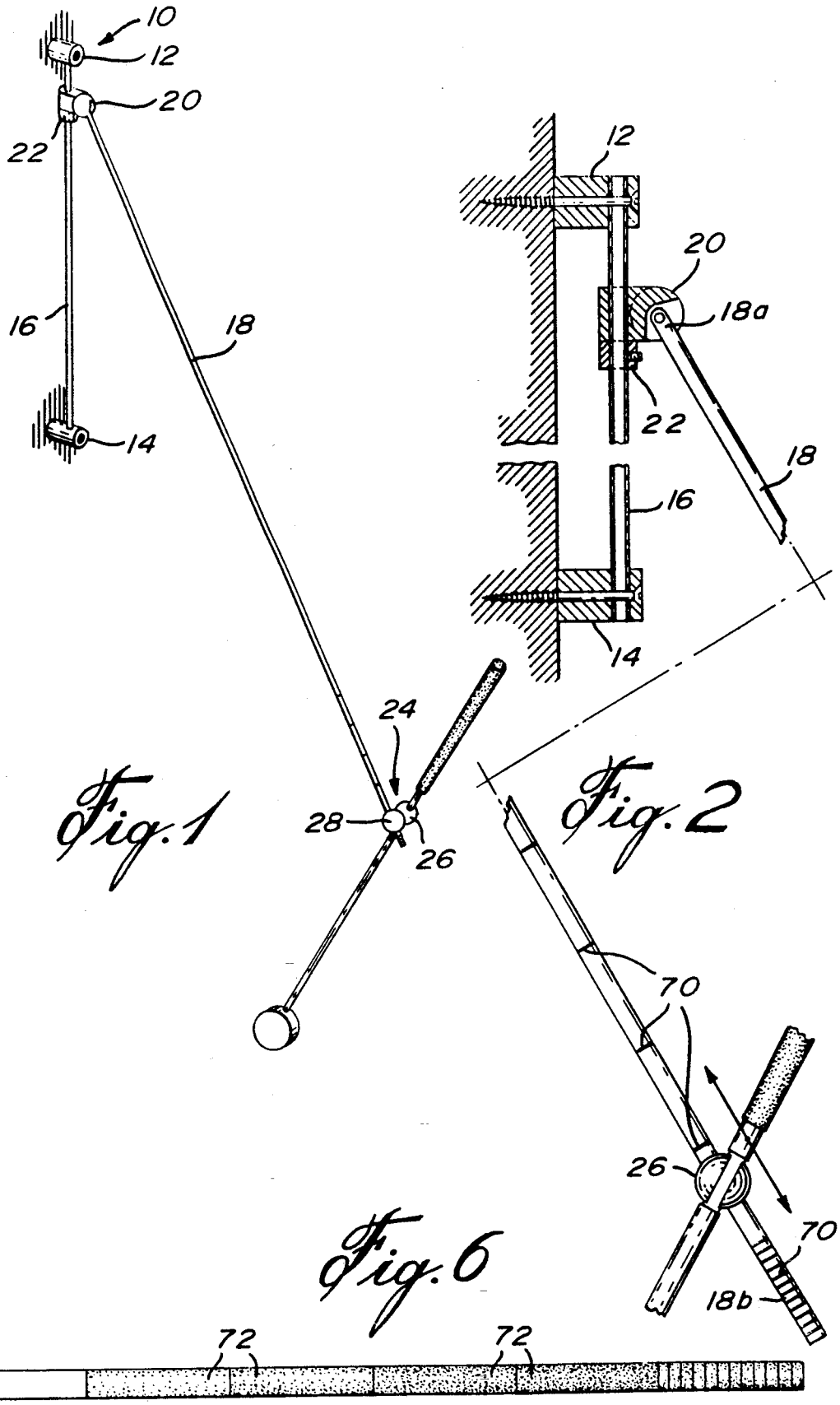
FIG. 1 is a perspective view of a teaching device made in accordance with the present invention.
FIG. 2 is a sectioned elevational view of such device.
FIG. 6, which is located on the first sheet illustrating
Figure 8B:
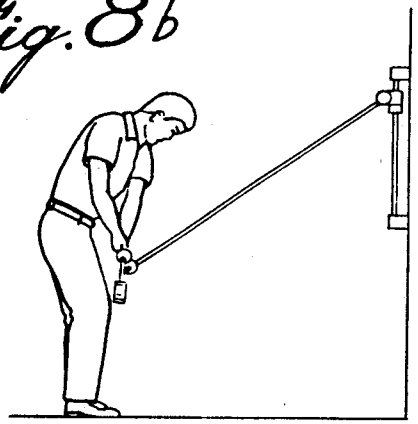
FIGS. 8*a* to 8*i* are schematic views of a golfer at various stages of a swing using the teaching device according to the present invention.
Figure 8D:
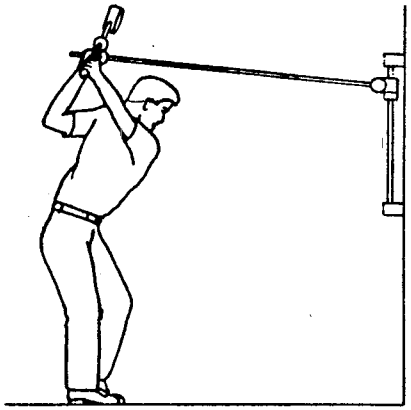
Figure 8A:
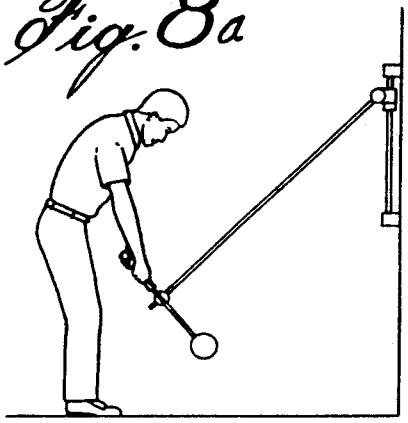
Figure 8C:
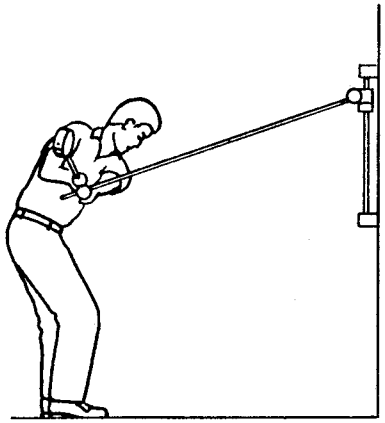

Referring to FIG. 1, there is shown an attachment, generally denoted 10, for mounting to a vertical surface, the attachment consisting of a pair of vertically spaced elements 12 and 14 mounted to the vertical surface and separated by a vertically extending rod 16. Such attachment may also consist of a suction cup, such as that described in the above-noted Canadian patent to Kane et al.

An elongated rigid rod 18 has its upper end 18*a* mounted to a swivel element 20 which, in turn, is adjustably secured to the vertical rod 16 of the attachment by an appropriate fastening element 22. The vertical adjustments of the attachment enables the device of the present invention to be used for various body configurations or various club lengths. The opposite end 18*b* of the rod is free, to which is mounted a connecting element, generally denoted 24.

Referring to FIG. 3, the connecting element 24 consists of a pair of spherical bodies 26 and 28 each having a C-shaped opening defined by opposite entrance faces 30, 32 and 34, 36, respectively, and with an inner circular face 38, 40, respectively. These bodies 26 and 28 are pivotally connected to one another by means of a pin 42 having its opposite heads 44 and 46 received in circular recesses 48 and 50.

A simulated golf club consisting of a hand grip portion 52, a shaft 54 and a head 56 is mounted in the connecting body 26. Referring more particularly to FIG. 4, the shaft 54 has a constricted cylindrical portion 60 of a diameter substantially equal to the distance separating the opposite faces 30 and 32 of body 26. Preferably, body 26 is made of a plastic material so that the distance between faces 30 and 32 may be slightly less than the diameter of portion 60 whereby the latter may be received in the inner circular cavity 38 of the body through a snap-in engagement. Preferably, the head 56 consists of a cylindrical body having opposite planar faces 62 and 64 to provide planar club faces to assist in the teaching of club face to the ground.

Similarly, the material of body 28 and the space between faces 34 and 36 may be slightly smaller than the diameter of the rod 18 so that the rod may be received within the circular inner cavity 50 of the body. However, it is important that the diameter of the rod be slightly less than the diameter of the cavity 50 so that the rod may freely slide within the body 28. In the case of rod 18 having a free unobstructed end 18*b*, the assembly of the rod to the body 28 may be effected endwise. Should the end be obstructed, then the snap-in engagement is needed.

Hence, with this arrangement, bodies 26 and 28 may pivot relative to one another so that an axis extending through the circular cavity 48 and an axis extending through the circular cavity 50, if rotated, will define planes which are always parallel to one another. Additionally, the shaft 54 is free to rotate about its own symmetrical axis within the circular recess 38 while the rod 18, longitudinally slidable within the circular cavity 50, may also rotate about its own symmetrical axis.

Figure 7:
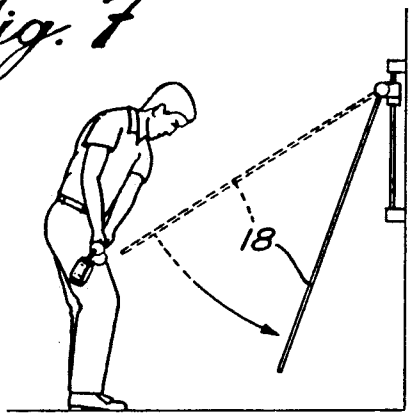
FIG. 7 shows an improper swing resulting in separation between the rod and the shaft.
Figure 8G:
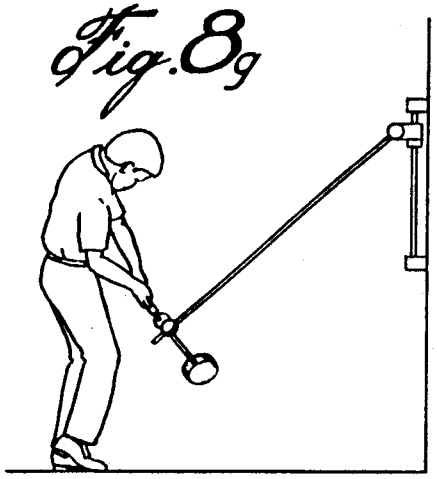
Figure 8F:
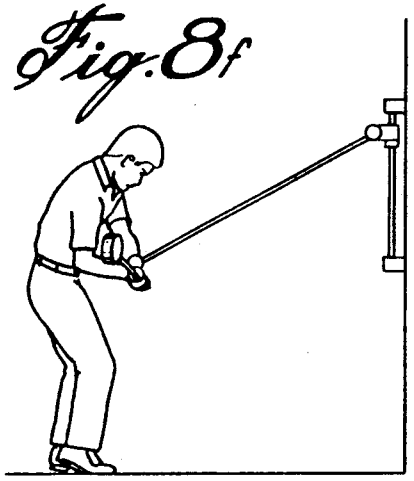
Figure 8E:
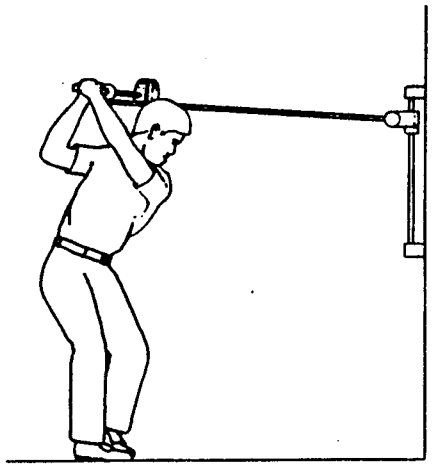
Figure 8H:
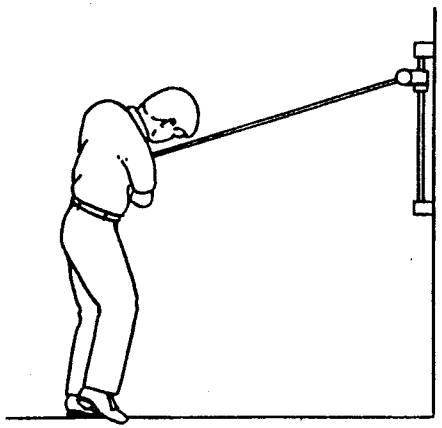
Figure 8I:
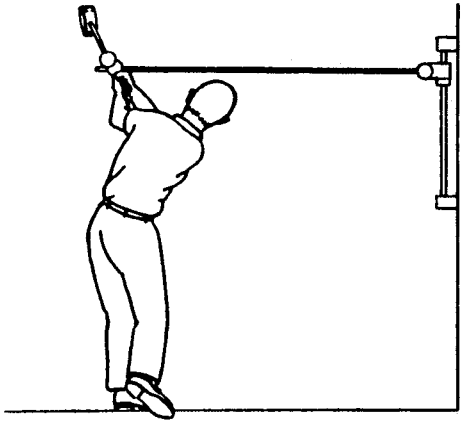

The free end 18*b* may have an extremity of identical diameter to that of the remaining part of the shaft so that an improper swing (such as illustrated in FIG. 7) will result in the removal and dropping off of the rod 18 from the shaft. However, although not illustrated, some stopper could be provided at the end of the rod preventing such removal while, at the same time, indicating to the golfer that he has reached an incorrect position during his or her swing.

FIGS. 8*a* to 8*i* show the relative positions of the rod and shaft during the backswing, downswing and follow-through movements of a golfer's swing. An instructor may be present to visualize and verify whether the relative positions between rod and shaft for a given golfer are correct or incorrect.

On the other hand, with particular usefulness for the case where an instructor is not present, the end 18*b* of the rod may include some means to indicate whether the relative position between rod and shaft is correct or incorrect. In FIG. 2, there are shown a series of notches 70 giving a "click" effect as they slide through the body 28, thus indicating audibly to the golfer whether he or she has less or more "clics" than determined for him or her. Similarly, as illustrated in FIG. 6, the rod end may be provided with a series of colour-coded areas 72 indicating visually to the golfer that he or she has reached the proper area for a given golf swing.

These notches or color-coded areas may be replaced with a spring device mounted at the end of the rod, such as shown in FIG. 9. This device consists of a helicoidal spring 80 slidably mounted at one end of the rod 18; one end of the spring abuts a cap 82 fixed to the extremity of the rod end while the opposite end is adapted to be contacted and compressed by a cylindrical connecting member 84 slidably mounted on rod 18' and having a function identical to that of member 28 of the embodiment illustrated in FIG. 1. Member 84 is pivotally mounted at 85 to a second cylindrical connecting member 86 which is fixedly retained on shaft 54' by means of a pair of O-rings 88 and 90 tightly engaged on shaft 54'. In the assembly of shaft 54', the cylindrical connecting members 84 and 86 are displaceable on rod 18' as indicated by arrow 92.

This spring allows the golfer to feel the planes (hands, shoulders..) from waist to top and not to stay in a too flat position, as soon as he or she starts the setting of the wrists. On the downward swing, by compressing the spring, it gets the club in a perfect angle of attack. During the all swing, it allows the golfer to understand the fact that the left arm (for a right-handed golfer) is supposed to remain close to the chest. It also plays the role of chock absorber in the impact zone.

Although the invention has been described above in relation to various forms, it will be evident to a person skilled in the art that it may be modified and refined in various ways. For example, the rod could be made telescopic to adapt to various heights of golfers, club lengths, etc. Hence, the simulated club could be replaced by actual golf clubs. It is therefore wished to have it understood that the present invention should not be limited in scope, except by the terms of the following claims.

I claim:

1. A device to assist in the teaching of a golfer's swing comprising:

attachment means adapted to be mounted to a vertical surface;

an elongated rigid rod having one end mounted in a swivel manner to said attachment means and an opposite end;

a shaft of a golf club or simulated club mounted to said rod adjacent said connecting means mounting said shaft to said rod; said connecting means including:

first means receiving therein said rod in a sliding manner whereby said connecting means may be displaced longitudinally along said rod; and second means receiving therein said shaft in a restrictive manner so that said connecting means is prevented from longitudinal movement along said shaft;

said first and second means being pivotally connected to one another so as to permit relative pivotal movement of said rod and said shaft to one another.

2. A device as defined in claim further comprising spring means mounted on said rod adjacent said opposite end, said spring means being compressible by said first means of said connecting means during a backward swing.

3. A device as defined in claim 2 wherein said spring means include a helicoidal spring having one end fixed at said opposite end of said rod and an opposite free end adapted to be contacted by said first means of said connecting means.

4. A device as defined in claim 1, further comprising means on said rod adjacent said opposite end to indicate location of said connecting means thereon at the beginning, during and at the end of a golfer's swing.

5. A device as defined in claim 4, wherein said location indicating means are visual.

6. A device as defined in claim 5, wherein said visual location indicating means consist of a series of colour-coded areas longitudinally displayed on said rod.

7. A device as defined in claim 4, wherein said location indicating means are audible.

8. A device as defined in claim 7, wherein said audible location indicating means consist of a series of longitudinally spaced notches on said rod being contacted by said first means.

9. A device as defined in claim 1, wherein said shaft is rotatably mounted in said second means so as to rotate about its symmetrical longitudinal axis.

10. A device as defined in claim 1, wherein said first and second means define openings C-shaped in cross-section and so dimensioned as to allow said rod and said shaft to be received respectively therein through a snap-in engagement.

11. A device as defined in claim 1, wherein said attachment means include means allowing vertical adjustment of said one end of said rod.

* * * * *